United States Patent [19]

Lee

[11] Patent Number: 4,938,634

[45] Date of Patent: Jul. 3, 1990

[54] PROCESS FOR LOWERING BASEMENT

[76] Inventor: Yuan-Ho Lee, No. 851, Chung-San Rd., Nan-Pao Tsun, Kuei-Jen Hsian, Tainan Hsieng, Taiwan

[21] Appl. No.: 371,339

[22] Filed: Jun. 26, 1989

[51] Int. Cl.[5] ..... E02D 27/00

[52] U.S. Cl. ..... 405/229; 52/294; 52/742; 52/745

[58] Field of Search ..... 405/195, 196, 229, 230; 52/294, 742, 745

[56] References Cited

U.S. PATENT DOCUMENTS

| | | | |
|---|---|---|---|
| 576,843 | 2/1897 | Gillespie | 405/220 |
| 2,007,498 | 7/1938 | Kida | 405/229 |
| 2,213,169 | 8/1940 | Ouchi | 405/229 |

FOREIGN PATENT DOCUMENTS

| | | | |
|---|---|---|---|
| 742166 | 11/1943 | Fed. Rep. of Germany | 405/229 |
| 748150 | 6/1933 | France | 405/230 |

*Primary Examiner*—Dennis L. Taylor
*Assistant Examiner*—John A. Ricci
*Attorney, Agent, or Firm*—Ladas & Parry

[57] ABSTRACT

In the construction of a building in which a basement is prefabricated on the ground and then lowered into the ground by excavating soil below the basement, a process for lowering the basement comprises: driving corrugated steel plates into the ground around a region in which the basement is to be installed; applying an adhesive on a surface of the basement adjacent to the steel plates; applying a lubricant on a surface of the basement adjacent to the surface of the basement; forming in-situ a flexible and resilient material in a space between the surfaces of the basement and the steel plates, the material serving as a guide member which is bonded securely to the basement; excavating soil below the basement; and causing the basement to descend into the ground.

6 Claims, 13 Drawing Sheets

PROCESS FOR LOWERING BASEMENT

BACKGROUND OF THE INVENTION

This invention relates to a process for lowering a basement into the ground.

As shown in FIG. 1, in an early process for constructing a basement, fence plates 11 are installed around a previously made excavation to prevent soil from falling thereinto, H-beams 12 are set up to bear against the fence plates, and then floors, walls, etc. are formed in the excavation.

An improved process developed in Italy called "ICOS process" is illustrated in FIGS. 2*a* to 2*d*. The process comprises excavating a marginal channel around a region in which a basement will be constructed followed by drilling holes successively in the ground along the channel (FIG. 2*a*), introducing a soil stabilizing solution into the ground during the hole drilling process (FIG. 2-*b*), placing a reinforcement frame in each hole (FIG. 2-*c*), and grouting each hole through tremie pipes (FIG. 2*d*). This process provides a continuous wall 15 as shown in FIG. 3, around the region in which the basement is to be formed. Excavation is effected in the region surrounded by the continuous wall 15. A first floor 17 of the basement is formed in the excavation and then soil is excavated for forming a second basement floor.

In a caisson process, a frame of a basement is prefabricated on the ground, and then the bottom of the frame is provided with cutting shoes to facilitate the lowering of the basement frame, as shown in FIG. 4*a*. After constructing the basement frame, the soil below the basement is excavated, as shown in FIG. 4*b* and is then conveyed away by means of skip buckets. During excavation, the storey above the basement is constructed simultaneously so that sufficient weight is added to force the basement frame downward as shown in FIG. 4*c*.

When the basement is lowered to a substantial depth, the speed of excavating at the central portion of the excavation is increased to achieve a predetermined depth. Then, piles are constructed from the central portion to the lateral portions as shown in FIG. 4*d*. After, the basement frame reaches a predetermined depth, concrete is formed on the basement frame. Final construction is shown in FIG. 4*e*.

The above-described caisson process overcomes many of the drawbacks existing in the conventional processes. However, the caisson process still suffers from several disadvantages. When the properties of the bearing soil are not uniform, the basement frame or the building constructed therein is liable to tilt. Furthermore, if the weight of the building above the basement frame is not sufficient, it may be impossible to force the basement frame down to a desired depth. Moreover, the process of providing cutting shoes at the bottom of the basement frame is difficult, and it is difficult to maintain a proper vertical descent of the basement frame by means of such shoes. The above described process is effective when a building is to be constructed on a bearing strata which is comprised of dense or hard soil. In a case where the bearing strata consists of loose soil, the surrounding soil falls into the region in which the basement will be installed, thereby adversely affecting the bearing capacity of the surrounding soil.

SUMMARY OF THE INVENTION

An object of the invention is to provide a process for lowering a basement of a building with an improvement which can prevent the soil or rock surrounding the excavation for the basement from collapsing during lowering the basement as well as facilitate the process of lowering the basement.

The present invention provides an improved process for the construction of a building in which a basement is prefabricated on the ground and then lowered into the ground by excavating soil below the basement, wherein the process for lowering the basement comprises: driving corrugated steel plates into the ground around a region in which the basement is to be installed; applying an adhesive on a surface of the basement adjacent to the steel plates; applying a lubricant on a surface of the steel plates adjacent to the surface of the basement; forming in-situ a flexible and resilient material in a space between the surfaces of the basement and the steel plates, the material serving as a guide member which is bonded securely to the basement; excavating soil below the basement; and causing the basement to descend into the ground. The process may further comprise supporting the basement with a pluraiity of hydraulic lifts so as to control the lowering of the basement.

The flexible and resilient material may be formed by curing a thermo-setting resin, such as a foamable polyurethane resin.

The present exemplary preferred embodiment will be described in detail with reference to the accompanying drawings, in which:

DETAILED DESCRIPTION OF THE PREFERRED EMBODIMENT

Figure 1:
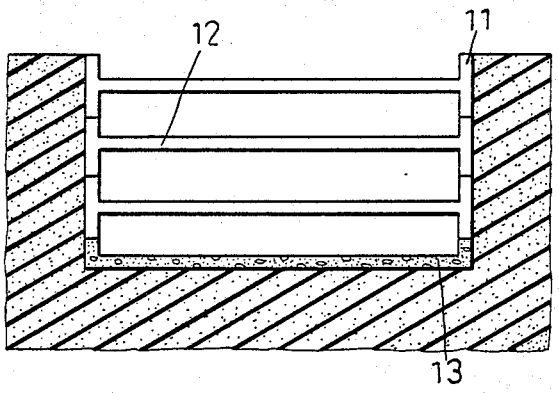
FIG. 1 PRIOR ART
FIG. 1 shows how an early process fabricates a basement of a building.
Figure 3:
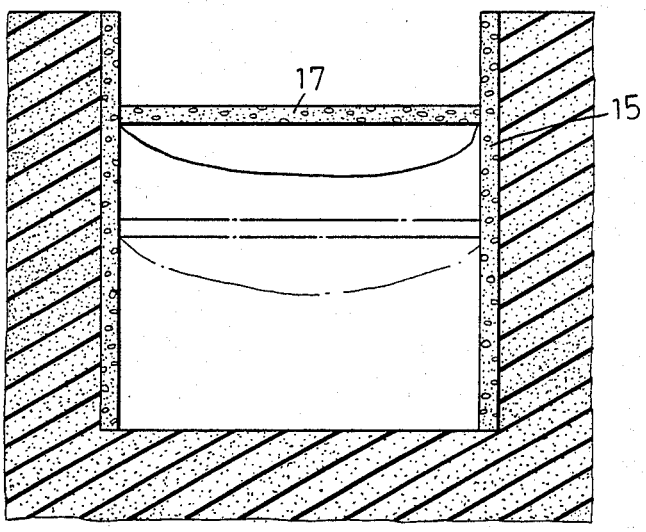
FIG. 3 PRIOR ART
FIGS. 2*a* to 2*d* and FIG. 3 show how another conventional process fabricates a basement of a building.
Figure 2C:
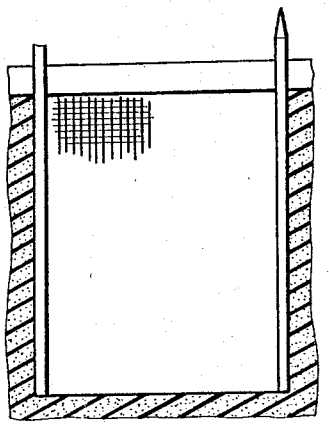
FIG. 2c PRIOR ART
Figure 2B:
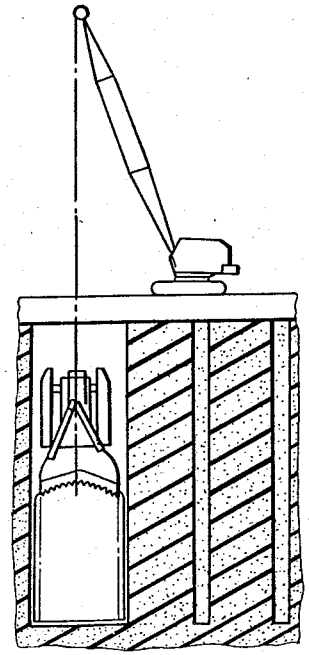
FIG. 2b PRIOR ART
Figure 2A:
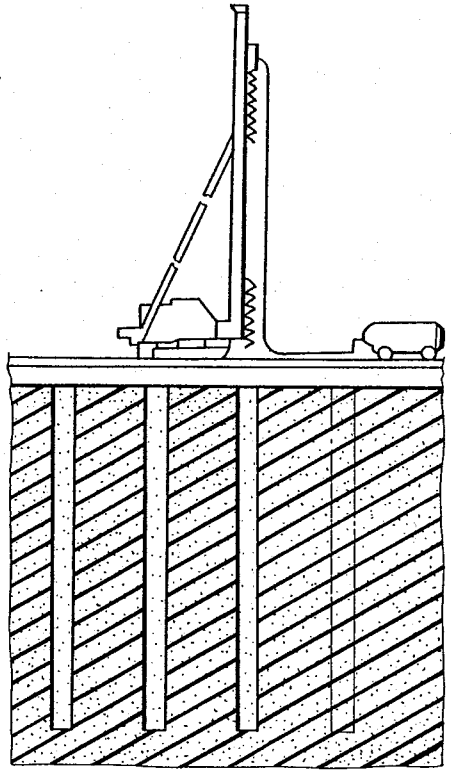
FIG. 2a PRIOR ART
Figure 2D:
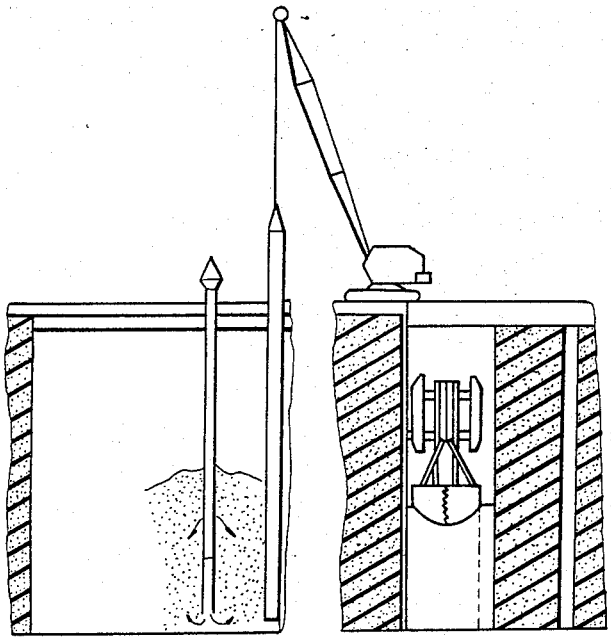
FIG. 2d PRIOR ART
Figure 4A:
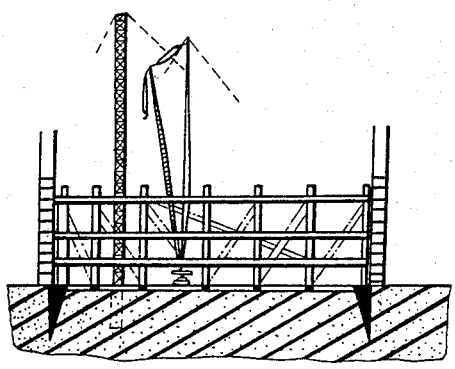
FIG. 4a PRIOR ART
FIGS. 4*a* to 4*e* show the operations of a caisson process for constructing a basement of a building.
Figure 4B:
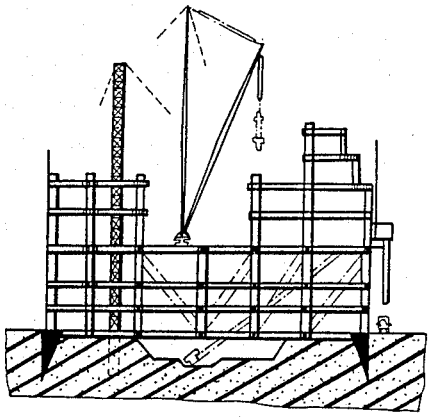
FIG. 4b PRIOR ART
Figure 4E:
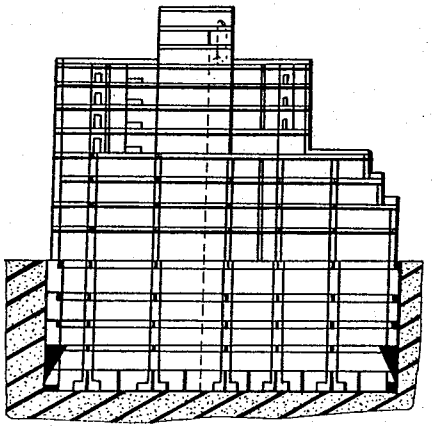
FIG. 4e PRIOR ART
Figure 4D:
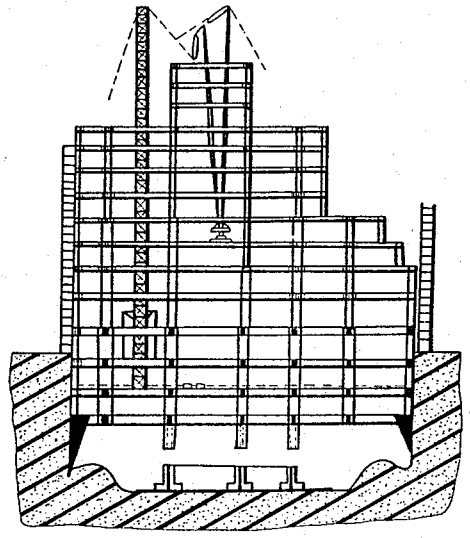
FIG. 4d PRIOR ART
Figure 4C:
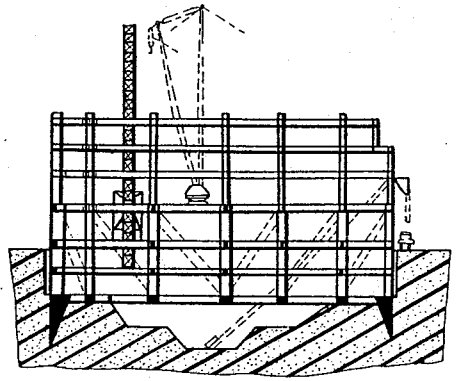
FIG. 4c PRIOR ART
Figure 5:
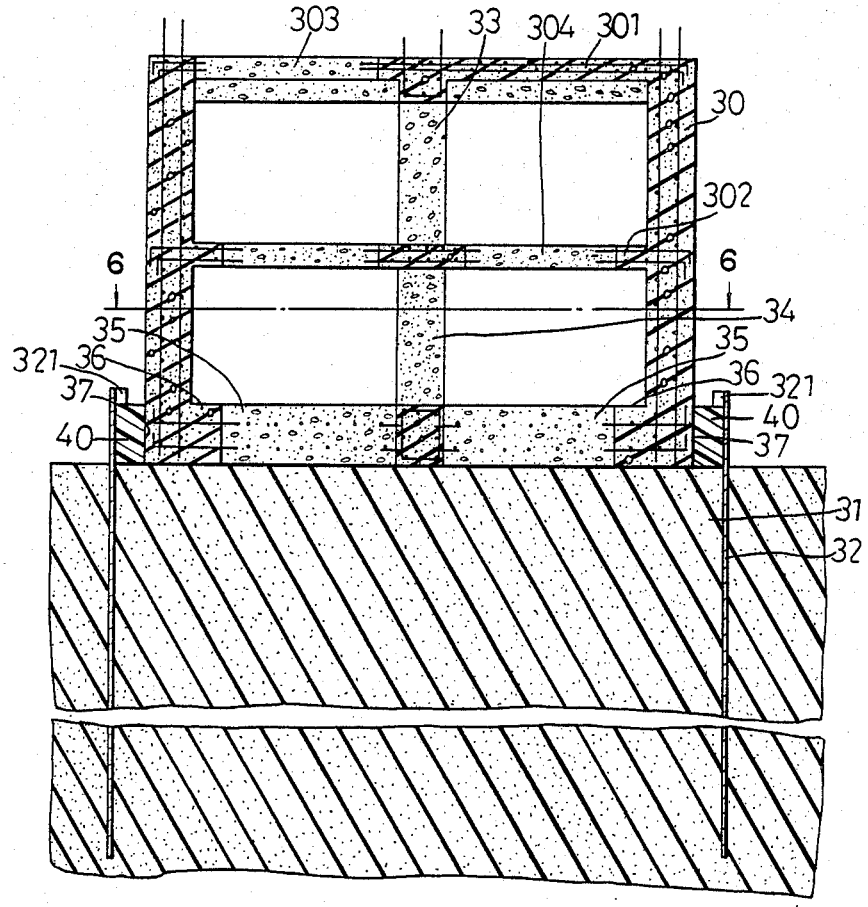
FIG. 5 shows an initial step of the process embodying the present invention.
Figure 6:
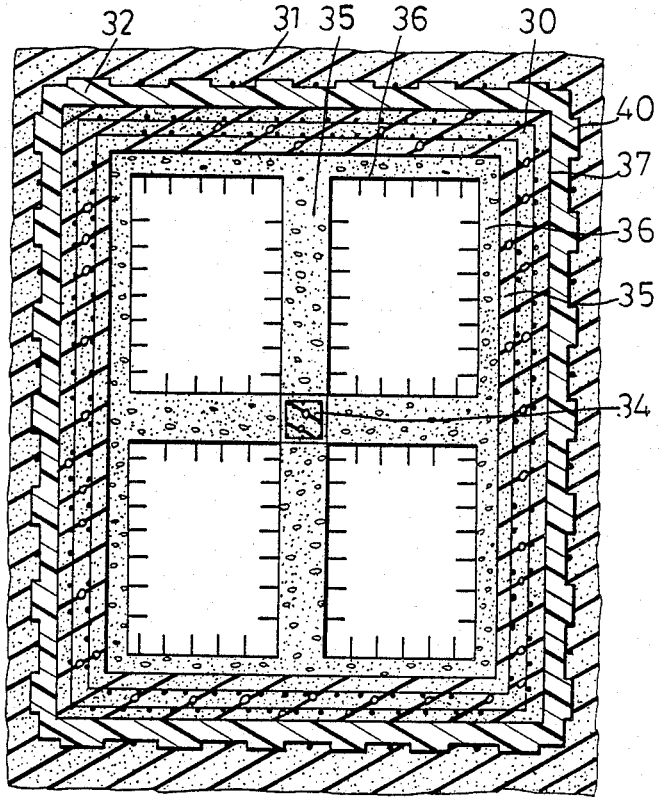
FIG. 6 a sectional view taken along 6—6 of FIG. 5.

FIGS. 5 to 8, a basememt 30 of a building which is constructed on the ground is shown. Corrugated steel plates 32 are driven into the ground around a region into which the basement structure 30 is to be lowered so that the surrounding soil can be prevented from falling into the region during the lowering operation. The basement structure 30 comprises two basement floors 301 and 302. In the first basement floor 301 and the second basement floor 302 are provided holes 303, 304 to serve as passages for the excavation. Walls 33, 34 are set up in the basement 30. At the bottommost end of the basement is provided a foundation 35 which comprises a four-sided wall member. The bottom of the wall member are provided with flanges 36 which extend inward.

The upper end portions 321 of the corrugated steel plates 32 extend upward from the ground. Flexible and resilient guide blocks 40 are formed in-situ between adjacent surfaces of the steel plates and the basement. Before the guide blocks 40 are formed, a polymeric adhesive is applied to the surface of the basement and a lubricant such as grease is applied on the surface of the steel plates 32. Then, a thermosetting resin composition, such as a foamable polyurethane composition, is poured into the space between the above described surfaces of the basement 30 and the steel plates 32. After the resin composition is cured, it forms the resilient blocks 40 which are bonded adhesively to the basement. The guide blocks 40 can slide easily along the steel plates 32.

Figure 7:
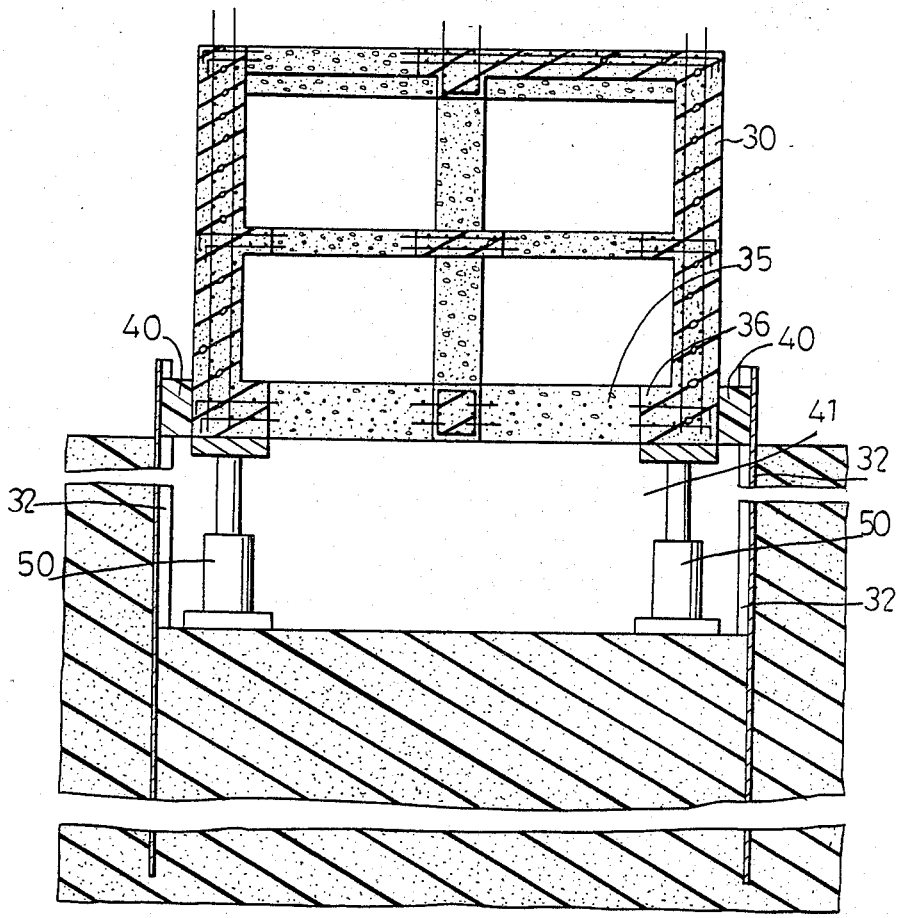
FIG. 7 shows how hydraulic lifts are used in the process shown in FIG. 5.
Figure 8:
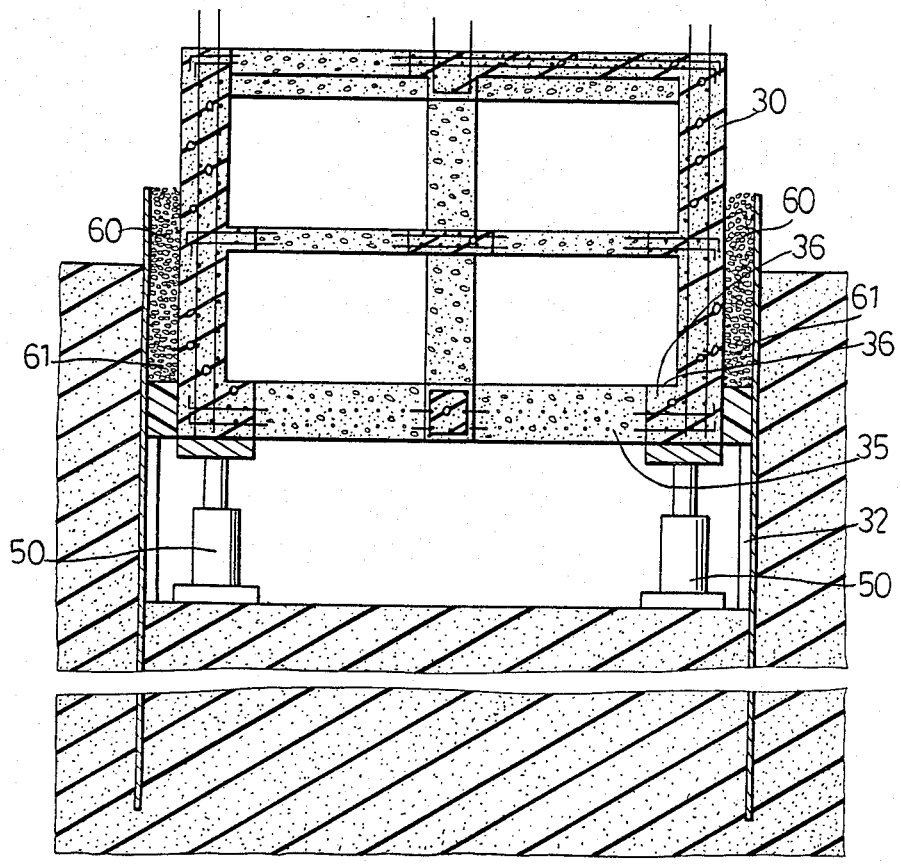
FIG. 8 shows the final step of the process shown in FIG. 5.
Figure 9:
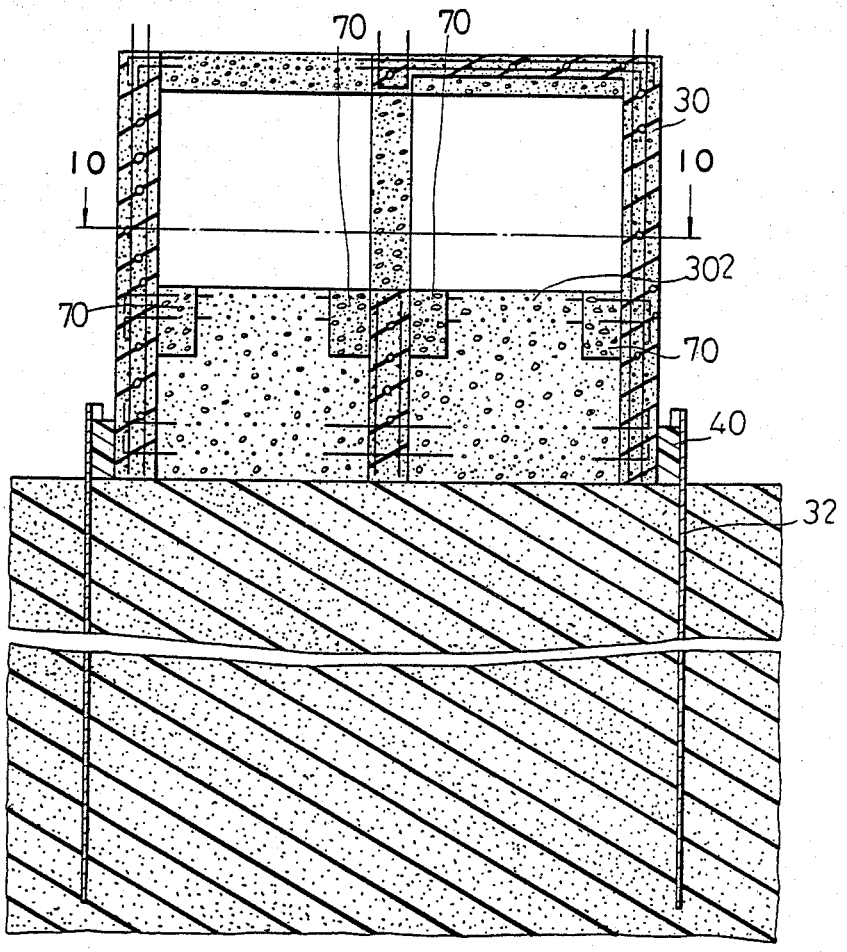
FIGS. 9–13 show how an alternative process of the present invention is performed.
Figure 10:
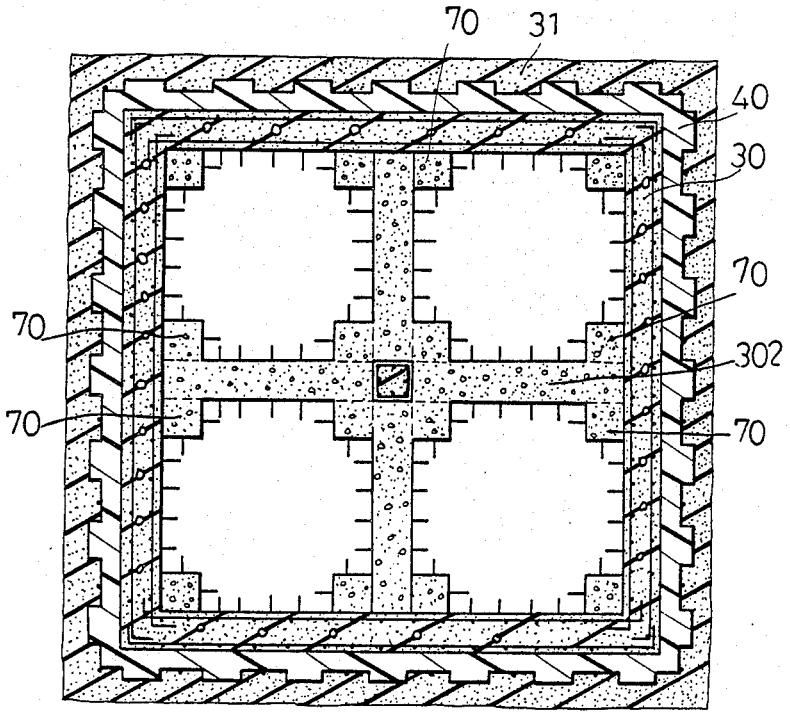
Figure 11:
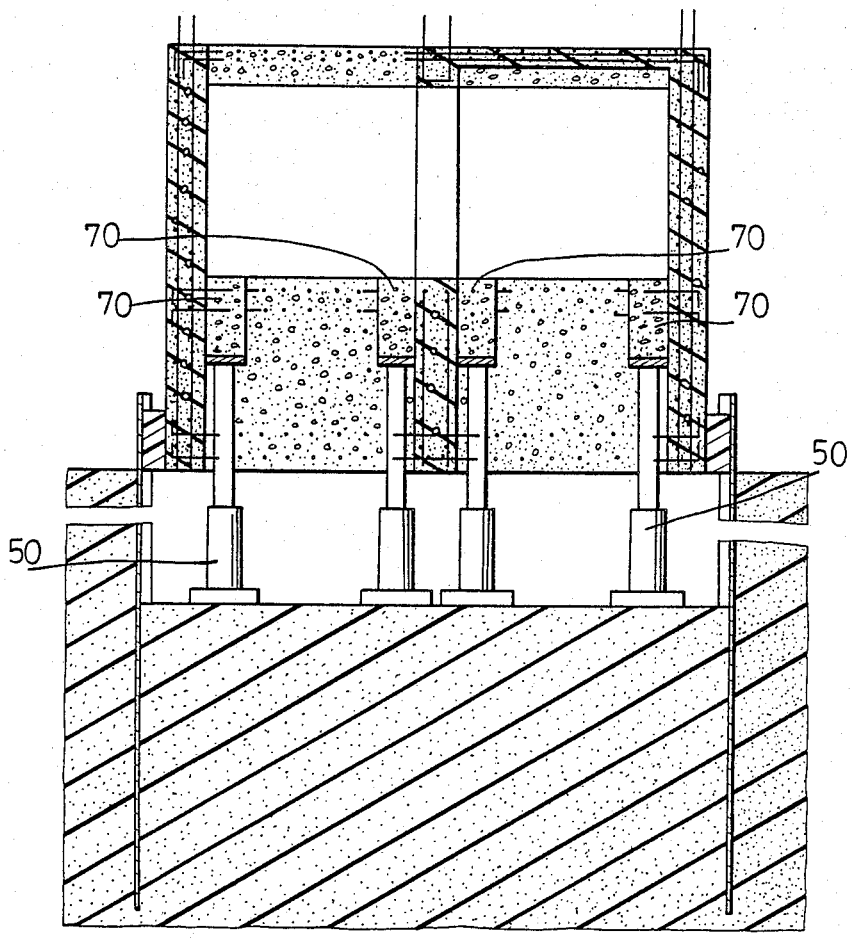
Figure 12:
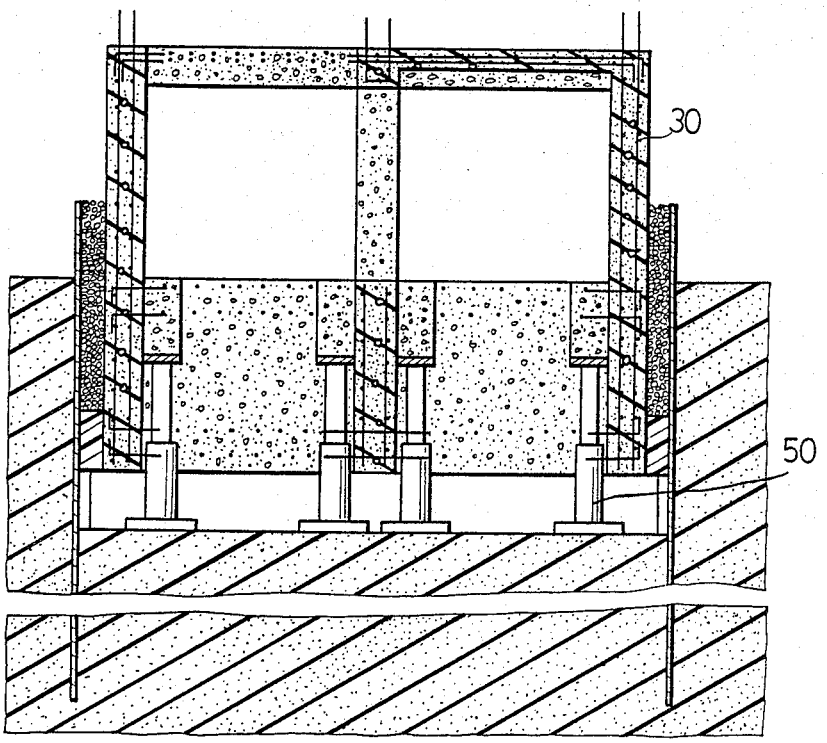

Soil below the basement is excavated to create a space 41 therebelow. Hydraulic lifts 50 are placed below the flanges 36 of the basement so as to support the flanges 36 as well as the basement as shown in FIG. 7. As the excavation continues, the basement is forced into the ground by the weight thereof as shown in FIG. 8. The hydraulic lifts 50 serve to maintain a uniform and steady rate of descent for the basement.

During the lowering of the basement, a gap is formed between the basement 30 and the steel plates 32 above the guide block 40. To avoid the deflection of the steel plates 32 and assure that the basement is properly lowered, the gap is filled with gravel 60. Preferably, the gap is filled with cohesive soil adjacent to the blocks 40 so that a good seal can be achieved between the blocks 40 and the steel plates 32 upon being compressed, thereby effectively preventing the falling of gravel into the space 41.

Figure 13:
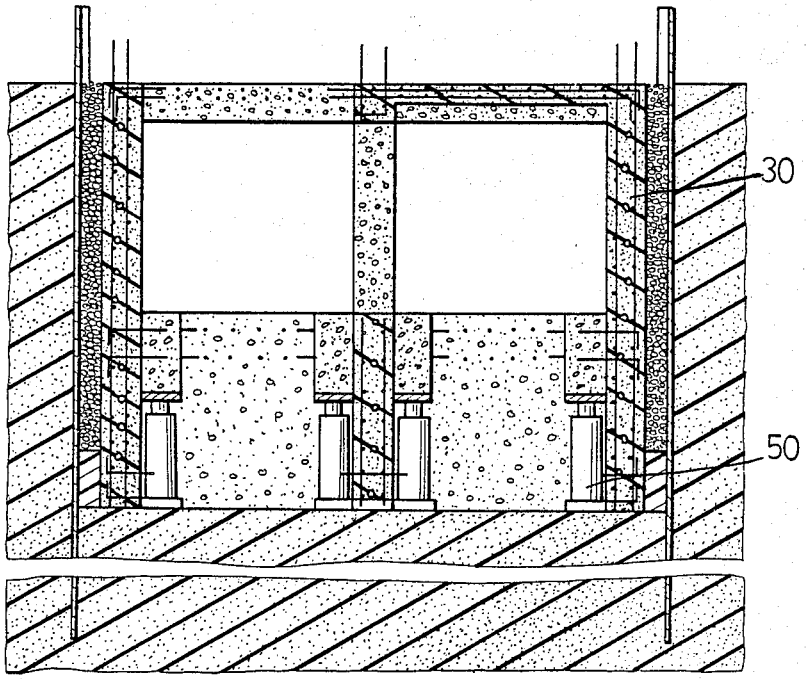

An alternative process is illustrated in FIGS. 9 to 13 in which like elements are represented by like numerals. This process differs from the previous process in that the basement 30 is not provided with flanges 36, but is provided with bearing blocks 70 which are attached to vertical walls of the basement. The supporting parts of the hydraulic lifts 50 press against the bearing blocks 70. The advantage of this embodiment is that the hydraulic lifts do not support the bottommost end of the basement and therefore the basement can be lowered to the bearing strata, as shown in FIG. 13.

In this process, the hydraulic lifts can be removed easily from the basement and no gap exists therebelow. It should be noted that gap between the basement and the bearing strata is necessary to be filled to ensure the stability of the building.

With the invention thus explained, it is apparent that various modifications and variations can be made without departing from the scope of the invention. It is therefore intended that the invention be limited only as indicated in the appended claims.

What I claim is:

1. In the construction of a building in which a basement is prefabricated on the ground and then lowered into the ground by excavating soil below the basement, a process for lowering the basement comprising:

driving corrugated steel plates into the ground around a region in which the basement is to be installed;

applying an adhesive on a surface of the basement adjacent to said steel plates;

applying a lubricant on a surface of said steel plates adjacent to said surface of said basement;

forming in-situ a flexible and resilient material in a space between said surfaces of the basement and the steel plates, said material serving as a guide member which is bonded securely to the basement;

excavating soil below the basement; and causing the basement to descend into the ground.

2. A process as claimed in claim 1, further comprising placing hydraulic lifts in the excavation formed below the basement and supporting the basement with said hydraulic lifts so as to control the lowering of the basement.

3. A process as claimed in claim 1, wherein said flexible and resilient material is formed by curing a thermosetting resin.

4. A process as claimed in claim 1, wherein said flexible and resilient material is formed by curing a foamable polyurethane resin.

5. A process as claimed in claim 1, further comprising filling the gap between the basement and the steel plates above said formed guide member with gravel.

6. A process as claimed in claim 1, further comprising filling the gap between the basement and the steel plates above said formed guide member with cohesive soil.

* * * * *